US007453077B2

(12) United States Patent
Bowering et al.

(10) Patent No.: US 7,453,077 B2
(45) Date of Patent: Nov. 18, 2008

(54) EUV LIGHT SOURCE

(75) Inventors: Norbert R. Bowering, San Diego, CA (US); Bjorn A. M. Hansson, La Jolla, CA (US); Rodney D. Simmons, San Diego, CA (US)

(73) Assignee: Cymer, Inc., San Diego, CA (US)

( * ) Notice: Subject to any disclaimer, the term of this patent is extended or adjusted under 35 U.S.C. 154(b) by 380 days.

(21) Appl. No.: 11/323,397

(22) Filed: Dec. 29, 2005

(65) Prior Publication Data

US 2007/0102653 A1 May 10, 2007

Related U.S. Application Data

(60) Provisional application No. 60/733,658, filed on Nov. 5, 2005.

(51) Int. Cl.
*G21K 5/04* (2006.01)

(52) U.S. Cl. ..... 250/504 R; 250/493.1; 250/503.1; 250/491.1; 250/396 R

(58) Field of Classification Search ..... 250/493.1, 250/503.1, 504 R, 491.1, 396 R
See application file for complete search history.

(56) References Cited

U.S. PATENT DOCUMENTS

| | | | | |
|---|---|---|---|---|
| 2,740,963 | A | 4/1956 | Donovan | 342/34 |
| 2,759,106 | A | 8/1956 | Wolter | 250/53 |
| 3,150,483 | A | 9/1964 | Mayfield et al. | 60/35.5 |
| 3,232,046 | A | 2/1966 | Meyer | 50/35.5 |
| 3,279,176 | A | 10/1966 | Boden | 60/202 |
| 3,746,870 | A | 7/1973 | Demarest | 250/227 |
| 3,960,473 | A | 6/1976 | Harris | 425/467 |
| 3,961,197 | A | 6/1976 | Dawson | 250/493 |
| 3,969,628 | A | 7/1976 | Roberts et al. | 250/402 |
| 4,009,391 | A | 2/1977 | Janes et al. | 250/281 |

(Continued)

FOREIGN PATENT DOCUMENTS

DE 10237901 B3 * 5/2004

(Continued)

OTHER PUBLICATIONS

Andreev, et al., "Enhancement of laser/EUV conversion by shaped laser pulse interacting with Li-contained targets for EUV lithography", *Proc. of SPIE*, 5196:128-136, (2004).

(Continued)

*Primary Examiner*—Jack I. Berman
*Assistant Examiner*—Michael J Logie
(74) *Attorney, Agent, or Firm*—William C. Cray

(57) ABSTRACT

An EUV light source and method of operating same is disclosed which may comprise: an EUV plasma production chamber comprising a chamber wall comprising an exit opening for the passage of produced EUV light focused to a focus point; a first EUV exit sleeve comprising a terminal end comprising an opening facing the exit opening; a first exit sleeve chamber housing the first exit sleeve and having an EUV light exit opening; a gas supply mechanism supplying gas under a pressure higher than the pressure within the plasma production chamber to the first exit sleeve chamber. The first exit sleeve may be tapered toward the terminal end opening, and may, e.g., be conical in shape comprising a narrowed end at the terminal end.

26 Claims, 3 Drawing Sheets

U.S. PATENT DOCUMENTS

| | | | | |
|---|---|---|---|---|
| 4,042,848 | A | 8/1977 | Lee | 313/231.6 |
| 4,088,966 | A | 5/1978 | Samis | 313/231.5 |
| 4,143,275 | A | 3/1979 | Mallozzi et al. | 250/503 |
| 4,162,160 | A | 7/1979 | Witter | 75/246 |
| 4,203,393 | A | 5/1980 | Giardini | 123/30 |
| 4,223,279 | A | 9/1980 | Bradford, Jr. et al. | 331/94.5 |
| 4,329,664 | A | 5/1982 | Javan | 359/276 |
| 4,364,342 | A | 12/1982 | Asik | 123/143 |
| 4,369,758 | A | 1/1983 | Endo | 123/620 |
| 4,455,658 | A | 6/1984 | Sutter et al. | 372/38 |
| 4,504,964 | A | 3/1985 | Cartz et al. | 378/119 |
| 4,507,588 | A | 3/1985 | Asmussen et al. | 315/39 |
| 4,534,035 | A | 8/1985 | Long | 372/85 |
| 4,536,884 | A | 8/1985 | Weiss et al. | 378/119 |
| 4,538,291 | A | 8/1985 | Iwamatsu | 378/119 |
| 4,550,408 | A | 10/1985 | Karning et al. | 372/58 |
| 4,561,406 | A | 12/1985 | Ward | 123/536 |
| 4,596,030 | A | 6/1986 | Herziger et al. | 378/119 |
| 4,618,971 | A | 10/1986 | Weiss et al. | 378/34 |
| 4,626,193 | A | 12/1986 | Gann | 431/71 |
| 4,633,492 | A | 12/1986 | Weiss et al. | 378/119 |
| 4,635,282 | A | 1/1987 | Okada et al. | 378/34 |
| 4,751,723 | A | 6/1988 | Gupta et al. | 378/119 |
| 4,752,946 | A | 6/1988 | Gupta et al. | 378/119 |
| 4,774,914 | A | 10/1988 | Ward | 123/162 |
| 4,837,794 | A * | 6/1989 | Riordan et al. | 378/119 |
| 4,891,820 | A | 1/1990 | Rando et al. | 372/93 |
| 4,928,020 | A | 5/1990 | Birx et al. | 307/106 |
| 4,959,840 | A | 9/1990 | Akins et al. | 372/57 |
| 5,005,180 | A | 4/1991 | Edelman et al. | 372/57 |
| 5,022,033 | A | 6/1991 | Hackell | 372/25 |
| 5,023,884 | A | 6/1991 | Akins et al. | 372/57 |
| 5,023,897 | A | 6/1991 | Neff et al. | 378/122 |
| 5,025,445 | A | 6/1991 | Anderson et al. | 372/20 |
| 5,025,446 | A | 6/1991 | Kuizenga | 372/21 |
| 5,027,076 | A | 6/1991 | Horsley et al. | 324/674 |
| 5,070,513 | A | 12/1991 | Letardi | 372/83 |
| 5,091,778 | A | 2/1992 | Keeler | 348/31 |
| 5,102,776 | A | 4/1992 | Hammer et al. | 430/311 |
| 5,126,638 | A | 6/1992 | Dethlefsen | 315/326 |
| 5,142,166 | A | 8/1992 | Birx | 307/419 |
| 5,142,543 | A | 8/1992 | Wakabayashi et al. | 372/32 |
| 5,157,684 | A | 10/1992 | Benda et al. | 372/95 |
| 5,171,360 | A | 12/1992 | Orme et al. | 75/331 |
| 5,175,755 | A | 12/1992 | Kumakhov | 378/34 |
| 5,181,135 | A | 1/1993 | Keeler | 398/104 |
| 5,189,678 | A | 2/1993 | Ball et al. | 372/28 |
| 5,226,948 | A | 7/1993 | Orme et al. | 75/331 |
| 5,259,593 | A | 11/1993 | Orme et al. | 266/78 |
| 5,313,481 | A | 5/1994 | Cook et al. | 372/37 |
| 5,315,611 | A | 5/1994 | Ball et al. | 372/56 |
| 5,319,695 | A | 6/1994 | Itoh et al. | 378/84 |
| 5,340,090 | A | 8/1994 | Orme et al. | 266/202 |
| 5,359,620 | A | 10/1994 | Akins | 372/58 |
| RE34,806 | E | 12/1994 | Cann | 427/446 |
| 5,411,224 | A | 5/1995 | Dearman et al. | 244/53 |
| 5,425,922 | A | 6/1995 | Kawaguchi | 422/186 |
| 5,448,580 | A | 9/1995 | Birx et al. | 372/38 |
| 5,450,436 | A | 9/1995 | Mizoguchi et al. | 372/59 |
| 5,463,650 | A | 10/1995 | Ito et al. | 372/57 |
| 5,471,965 | A | 12/1995 | Kapich | 123/565 |
| 5,504,795 | A | 4/1996 | McGeoch | 378/119 |
| 5,563,555 | A | 10/1996 | Nalos et al. | 331/81 |
| 5,729,562 | A | 3/1998 | Birx et al. | 372/38 |
| 5,763,930 | A | 6/1998 | Partlo | 250/504 |
| 5,852,621 | A | 12/1998 | Sandstrom | 372/25 |
| 5,856,991 | A | 1/1999 | Ershov | 372/57 |
| 5,863,017 | A | 1/1999 | Larson et al. | 248/176.1 |
| 5,866,871 | A | 2/1999 | Birx | 219/121 |
| 5,894,980 | A | 4/1999 | Orme-Marmarelis et al. | 228/33 |
| 5,894,985 | A | 4/1999 | Orme-Marmarelis et al. | 228/262 |
| 5,933,271 | A | 8/1999 | Waarts et al. | 359/341.31 |
| 5,936,988 | A | 8/1999 | Partlo et al. | 372/38 |
| 5,938,102 | A | 8/1999 | Muntz et al. | 228/102 |
| 5,953,360 | A | 9/1999 | Vitruk et al. | 372/87 |
| 5,963,616 | A | 10/1999 | Silfvast et al. | 378/122 |
| 5,970,076 | A | 10/1999 | Hamada | 372/20 |
| 5,978,394 | A | 11/1999 | Newman et al. | 372/32 |
| 5,991,324 | A | 11/1999 | Knowles et al. | 372/57 |
| 6,005,879 | A | 12/1999 | Sandstrom et al. | 372/25 |
| 6,016,323 | A | 1/2000 | Kafka et al. | 372/38 |
| 6,016,325 | A | 1/2000 | Ness et al. | 372/38 |
| 6,018,537 | A | 1/2000 | Hofmann et al. | 372/25 |
| 6,028,880 | A | 2/2000 | Carlesi et al. | 372/58 |
| 6,031,241 | A | 2/2000 | Silfvast et al. | 250/504 |
| 6,031,598 | A | 2/2000 | Tichenor et al. | 355/67 |
| 6,039,850 | A | 3/2000 | Schulz | 204/192.15 |
| 6,051,841 | A | 4/2000 | Partlo | 250/504 |
| 6,064,072 | A | 5/2000 | Partlo et al. | 250/504 |
| 6,067,311 | A | 5/2000 | Morton et al. | 372/57 |
| 6,094,448 | A | 7/2000 | Fomenkov et al. | 372/102 |
| 6,104,735 | A | 8/2000 | Webb | 372/37 |
| 6,128,323 | A | 10/2000 | Myers et al. | 372/38.1 |
| 6,151,346 | A | 11/2000 | Partlo et al. | 372/38 |
| 6,151,349 | A | 11/2000 | Gong et al. | 372/58 |
| 6,164,116 | A | 12/2000 | Rice et al. | 73/1.72 |
| 6,172,324 | B1 | 1/2001 | Birx | 219/121.57 |
| 6,181,719 | B1 | 1/2001 | Sukhman et al. | 372/38.1 |
| 6,186,192 | B1 | 2/2001 | Orme-Marmarelis et al. | 141/18 |
| 6,192,064 | B1 | 2/2001 | Algots et al. | 372/99 |
| 6,195,272 | B1 | 2/2001 | Pascente | 363/21 |
| 6,208,674 | B1 | 3/2001 | Webb et al. | 372/57 |
| 6,208,675 | B1 | 3/2001 | Webb | 372/58 |
| 6,219,368 | B1 | 4/2001 | Govorkov | 372/59 |
| 6,224,180 | B1 | 5/2001 | Pham-Van-Diep et al. | 347/2 |
| 6,228,512 | B1 | 5/2001 | Bajt et al. | 428/635 |
| 6,240,117 | B1 | 5/2001 | Gong et al. | 372/58 |
| 6,264,090 | B1 | 7/2001 | Muntz et al. | 228/33 |
| 6,276,589 | B1 | 8/2001 | Watts, Jr. et al. | 228/33 |
| 6,281,471 | B1 | 8/2001 | Smart | 219/121.61 |
| 6,285,743 | B1 | 9/2001 | Kondo et al. | 378/119 |
| 6,304,630 | B1 | 10/2001 | Bisschops et al. | 378/119 |
| 6,307,913 | B1 | 10/2001 | Foster et al. | 378/34 |
| 6,317,448 | B1 | 11/2001 | Das et al. | 372/32 |
| 6,359,922 | B1 | 3/2002 | Partlo et al. | 372/58 |
| 6,370,174 | B1 | 4/2002 | Onkels et al. | 372/38.04 |
| 6,377,651 | B1 | 4/2002 | Richardson et al. | 378/34 |
| 6,381,257 | B1 | 4/2002 | Ershov et al. | 372/57 |
| 6,392,743 | B1 | 5/2002 | Zambon et al. | 355/69 |
| 6,396,900 | B1 | 5/2002 | Barbee, Jr. et al. | 378/84 |
| 6,404,784 | B2 | 6/2002 | Komine | 372/9 |
| 6,414,979 | B2 | 7/2002 | Ujazdowski et al. | 372/87 |
| 6,442,181 | B1 | 8/2002 | Oliver et al. | 372/25 |
| 6,449,086 | B1 | 9/2002 | Singh | 359/361 |
| 6,452,194 | B2 | 9/2002 | Bijkerk et al. | 250/492.2 |
| 6,452,199 | B1 | 9/2002 | Partlo et al. | 250/504 |
| 6,466,602 | B1 | 10/2002 | Fleurov et al. | 372/87 |
| 6,477,193 | B2 | 11/2002 | Oliver et al. | 372/58 |
| 6,491,737 | B2 | 12/2002 | Orme-Marmerelis et al. | 75/335 |
| 6,493,374 | B1 | 12/2002 | Fomenkov et al. | 372/102 |
| 6,493,423 | B1 | 12/2002 | Bisschops | 378/119 |
| 6,504,903 | B1 * | 1/2003 | Kondo et al. | 378/119 |
| 6,520,402 | B2 | 2/2003 | Orme-Marmerelis et al. | 228/260 |
| 6,529,531 | B1 | 3/2003 | Everage et al. | 372/20 |
| 6,532,247 | B2 | 3/2003 | Spangler et al. | 372/61 |
| 6,535,531 | B1 | 3/2003 | Smith et al. | 372/25 |
| 6,538,737 | B2 | 3/2003 | Sandstrom et al. | 356/334 |
| 6,549,551 | B2 | 4/2003 | Ness et al. | 372/38.07 |
| 6,553,049 | B1 | 4/2003 | Besaucele et al. | 372/57 |
| 6,562,099 | B2 | 5/2003 | Orme-Marmerelis et al. | 75/335 |
| 6,566,667 | B1 | 5/2003 | Partlo et al. | 250/504 |

| | | | | |
|---|---|---|---|---|
| 6,566,668 | B2 | 5/2003 | Rauch et al. | 250/504 |
| 6,567,450 | B2 | 5/2003 | Myers et al. | 372/55 |
| 6,567,499 | B2 | 5/2003 | McGeoch | 378/119 |
| 6,576,912 | B2 | 6/2003 | Visser et al. | 250/492.2 |
| 6,580,517 | B2 | 6/2003 | Lokai et al. | 356/519 |
| 6,584,132 | B2 | 6/2003 | Morton | 372/57 |
| 6,586,757 | B2 | 7/2003 | Melnychuk et al. | 250/504 |
| 6,590,922 | B2 | 7/2003 | Onkels | 372/57 |
| 6,590,959 | B2 | 7/2003 | Kandaka et al. | 378/119 |
| 6,618,421 | B2 | 9/2003 | Das et al. | 372/55 |
| 6,621,846 | B1 | 9/2003 | Sandstrom et al. | 372/57 |
| 6,625,191 | B2 | 9/2003 | Knowles et al. | 372/55 |
| 6,635,844 | B2 | 10/2003 | Yu | 219/121.68 |
| 6,647,086 | B2 | 11/2003 | Amemiya et al. | 378/34 |
| 6,656,575 | B2 | 12/2003 | Bijkerk et al. | 428/212 |
| 6,671,294 | B2 | 12/2003 | Kroyan et al. | 372/20 |
| 6,714,624 | B2 | 3/2004 | Fornaciari et al. | 378/119 |
| 6,721,340 | B1 | 4/2004 | Fomenkov et al. | 372/25 |
| 6,724,462 | B1 | 4/2004 | Singh et al. | 355/53 |
| 6,744,060 | B2 | 6/2004 | Ness et al. | 315/111.01 |
| 6,757,316 | B2 | 6/2004 | Newman et al. | 372/57 |
| 6,765,945 | B2 | 7/2004 | Sandstrom et al. | 372/57 |
| 6,780,496 | B2 | 8/2004 | Bajt et al. | 425/216 |
| 6,782,031 | B1 | 8/2004 | Hofmann et al. | 372/90 |
| 6,795,474 | B2 | 9/2004 | Partlo et al. | 372/57 |
| 6,804,327 | B2 | 10/2004 | Schriever et al. | 378/119 |
| 6,815,700 | B2 | 11/2004 | Melnychuk et al. | 250/504 |
| 6,822,251 | B1 * | 11/2004 | Arenberg et al. | 250/504 R |
| 6,865,255 | B2 | 3/2005 | Richardson | 378/119 |
| 6,882,704 | B2 * | 4/2005 | Schriever et al. | 378/119 |
| 6,891,172 | B2 * | 5/2005 | Ohgushi et al. | 250/492.2 |
| 7,323,703 | B2 * | 1/2008 | Oliver et al. | 250/504 R |
| 7,388,220 | B2 * | 6/2008 | Fomenkov et al. | 250/504 R |
| 2001/0006217 | A1 | 7/2001 | Bisschops | 250/493.1 |
| 2001/0055364 | A1 | 12/2001 | Kandaka et al. | 379/119 |
| 2002/0009176 | A1 | 1/2002 | Ameniya et al. | 378/34 |
| 2002/0014598 | A1 | 2/2002 | Melnychuk et al. | 250/504 R |
| 2002/0014599 | A1 | 2/2002 | Rauch et al. | 250/504 R |
| 2002/0021728 | A1 | 2/2002 | Newman et al. | 375/55 |
| 2002/0048288 | A1 | 4/2002 | Kroyan et al. | 372/20 |
| 2002/0100882 | A1 | 8/2002 | Schriever et al. | 250/504 |
| 2002/0114370 | A1 | 8/2002 | Onkels et al. | 372/55 |
| 2002/0141536 | A1 | 10/2002 | Richardson | 378/119 |
| 2002/0162973 | A1 | 11/2002 | Condingley et al. | 250/492.2 |
| 2002/0163793 | A1 * | 11/2002 | Jonkers | 362/34 |
| 2002/0168049 | A1 | 11/2002 | Schriever et al. | 378/119 |
| 2003/0006383 | A1 * | 1/2003 | Melnychuk et al. | 250/504 R |
| 2003/0068012 | A1 | 4/2003 | Ahmad et al. | 378/119 |
| 2003/0196512 | A1 | 10/2003 | Wyszomierski et al. | 75/336 |
| 2003/0219056 | A1 | 11/2003 | Yager et al. | 372/57 |
| 2004/0047385 | A1 | 3/2004 | Knowles et al. | 372/55 |
| 2004/0071267 | A1 * | 4/2004 | Jacob et al. | 378/119 |
| 2004/0145292 | A1 * | 7/2004 | Ahmad et al. | 313/231.31 |
| 2004/0160155 | A1 * | 8/2004 | Partlo et al. | 313/231.31 |
| 2004/0160583 | A1 * | 8/2004 | Mulkens et al. | 355/30 |
| 2005/0157311 | A1 * | 7/2005 | Kuchel | 356/513 |
| 2005/0174576 | A1 | 8/2005 | Rao et al. | 356/454 |
| 2006/0169929 | A1 * | 8/2006 | Wassink | 250/504 R |
| 2007/0012889 | A1 * | 1/2007 | Sogard | 250/504 R |
| 2007/0023706 | A1 * | 2/2007 | Sjmaenok et al. | 250/504 R |

FOREIGN PATENT DOCUMENTS

| | | |
|---|---|---|
| JP | 02-105478 | 4/1990 |
| JP | 03-173189 | 7/1991 |
| JP | 06-053594 | 2/1994 |
| JP | 09-219555 | 8/1997 |
| JP | 2000-058944 | 2/2000 |
| JP | 2000091096 A | 3/2000 |
| WO | WO2004/104707 | 12/2004 |

OTHER PUBLICATIONS

Apruzese, J.P., "X-Ray Laser Research Using Z Pinches," *Am. Inst. of Phys*. 399-403, (1994).

Bollanti, et al., "Compact Three Electrodes Excimer Laser IANUS for a POPA Optical System," *SPIE Proc*. (2206)144-153, (1994).

Bollanti, et al., "Ianus, the three-electrode excimer laser," *App. Phys. B* (*Lasers & Optics*) 6(4):401-406, (1998).

Braun, et al., "Multi-component EUV Multilayer Mirrors," *Proc. SPIE*, 5037:2-13, (2003).

Choi, et al., "Fast pulsed hollow cathode capillary discharge device," *Rev. of Sci. Instrum*. 69(9):3118-3122 (1998).

Choi et al., Temporal development of hard and soft x-ray emission from a gas-puff Z pinch, *Rev. Sci. Instrum*. 57(8), pp. 2162-2164 (Aug. 1986).

Coutts et al., "High average power blue generation from a copper vapour laser pumped titanium sapphire laser", Journal of Modern Optics, vol. 45, No. 6, p. 1185-1197 (1998).

Eckhardt, et al., "Influence of doping on the bulk diffusion of Li into Si(100)," *Surface Science* 319 (1994) 219-223.

Eichler, et al., "Phase conjugation for realizing lasers with diffraction limited beam quality and high average power," Techninische Universitat Berlin, Optisches Institut, (Jun. 1998).

Fedosejevs et al., "Subnanosecond pulses from a KrF Laser pumped $SF_6$ Brillouin Amplifier", *IEEE J. QE* 21, 1558-1562 (1985).

Feigl, et al., "Heat Resistance of EUV Multilayer Mirrors for Long-time Applications," *Microelectric Engineering*, 57-58:3-8, (2001).

Fomenkov, et al., "Characterization of a 13.5nm Source for EUV Lithography based on a Dense Plasma Focus and Lithium Emission," Sematech Intl. Workshop on EUV Lithography (Oct. 1999).

Giordano et al., "Magnetic pulse compressor for prepulse discharge in spiker-sustainer excitati technique for XeCl lasers," *Rev. Sci. Instrum* 65(8), pp. 2475-2481 (Aug. 1994).

Hansson, et al., "Xenon liquid jet laser-plasma source for EUV lithography," Emerging Lithographic Technologies IV, *Proc. of SPIE*, vol. 3997:729-732 (2000).

Hercher, "Tunable single mode operation of gas lasers using intracavity tilted etalons," Applied Optics, vol. 8, No. 6, Jun. 1969, pp. 1103-1106.

Jahn, Physics of Electric Propulsion, McGraw-Hill Book Company, (Series in Missile and Space U.S.A.), Chap. 9, "Unsteady Electromagnetic Acceleration," p. 257 (1968).

Jiang, et al., "Compact multimode pumped erbium-doped phosphate fiber amplifiers," *Optical Engineering*, vol. 42, Issue 10, pp. 2817-2820 (Oct. 2003).

Kato, Yasuo, "Electrode Lifetimes in a Plasma Focus Soft X-Ray Source," *J. Appl. Phys*. (33) Pt. 1, No. 8:4742-4744 (1991).

Kato, et al., "Plasma focus x-ray source for lithography," *Am. Vac. Sci. Tech. B*., 6(1): 195-198 (1988).

Kjornrattanawanich, Ph.D. Dissertation, U.S. Department of Energy, Lawrence Livermore National Laboratory, Sep. 1, 2002.

Kloidt et al., "Enhancement of the reflectivity of Mo/Si multilayer x-ray mirrors by thermal treatment," *Appl. Phys. Lett*. 58(23), 2601-2603 (1991).

Kuwahara et al., "Short-pulse generation by saturated KrF laser amplification of a steep Stokes pulse produced by two-step stimulated Brillouin scattering", *J. Opt. Soc. Am*. B 17, 1943-1947 (2000).

Lange, Michael R., et al., "High gain coefficient phosphate glass fiber amplifier," NFOEC 2003, paper No. 126.

Lebert, et al., "Soft x-ray emission of laser-produced plasmas using a low-debris cryogenic nitrogen target," *J. App. Phys*., 84(6):3419-3421 (1998).

Lebert, et al., "A gas discharged based radiation source for EUV-lithography," Intl. Conf. Micro and Nano-Engineering 98 (Sep. 22-24, 1998) Leuven, Belgium.

Lebert, et al., "Investigation of pinch plasmas with plasma parameters promising ASE," Inst. Phys. Conf. Ser No. 125: Section 9, pp. 411-415 (1992) Schiersee, Germany.

Lebert, et al., "Comparison of laser produced and gas discharge based EUV sources for different applications," Intl. Conf. Micro- and Nano-Engineering 98 (Sep. 22-24, 1998) Leuven, Belgium.

Lee, Ja H., "Production of dense plasmas in hypocycloidal pinch apparatus," *The Phys. Of Fluids*, 20(2):313-321 (1977).
Lewis, Ciaran L.S., "Status of Collision-Pumped X-ray Lasers," *Am. Inst. Phys*. pp. 9-16 (1994).
Lowe, "Gas plasmas yield X-rays for Lithography," *Electronics*, pp. 40-41 (Jan. 27, 1982).
Malmquist, et al., "Liquid-jet target for laser-plasma soft x-ray generation," *Am. Inst. Phys*. 67(12):4150-4153 (1996).
Maruyama et al., Characteristics of high-power excimer laser master oscillator power amplifier system for dye laser pumping, Optics Communications, vol. 87, No. 3 p. 105-108 (1992).
Mather, "Formation of a High-Density Deuterium Plasma Focus," *Physics of Fluids*, 8(2), 366-377 (Feb. 1965).
Mather, et al., "Stability of the Dense Plasma Focus," *Phys. Of Fluids*, 12(11):2343-2347 (1969).
Matthews and Cooper, "Plasma sources for x-ray lithography," *SPIE, vol. 333 Submicron Lithography*, pp. 136-139 (1982).
Mayo, et al., "A magnetized coaxial source facility for the generation of energetic plasma flows," *Sci. Technol*. vol. 4:pp. 47-55 (1994).
Mayo, et al., "Initial Results on high enthalpy plasma generation in a magnetized coaxial source," *Fusion Tech* vol. 26:1221-1225 (1994).
Mitsuyama, et al., "Compatibility of insulating ceramic materials with liquid breeders," *Fusion Eng. and Design* 39-40 (1998) 811-817.
Montcalm et al., "Mo/Y multiplayer mirrors for the 8-12-nm wavelength region," *Optics Letters*, 19(15): 1173-1175 (Aug. 1, 1994).
Montcalm et al., "In situ reflectance measurements of soft-s-ray/extreme-ultraviolet Mo/Y multiplayer mirrors," *Optics Letters* 20(12): 1450-1452 (Jun. 15, 1995).
Nilsen et al., "Mo:Y multiplayer mirror technology utilized to image the near-field output of a Ni-like Sn laser at 11.9 nm," *Optics Letters*, 28(22) 2249-2251 (Nov. 15, 2003).
Nilsen, et al., "Analysis of resonantly photopumped Na-Ne x-ray-laser scheme," *Am Phys. Soc*. 44(7):4591-4597 (1991).
H. Nishioka et al., "UV saturable absorber for short-pulse KrF laser systems", *Opt. Lett*, 14, 692-694 (1989).
Orme, et al., "Electrostatic charging and deflection of nonconventional droplet streams formed from capillary stream breakup," *Physics of Fluids*, 12(9):2224-2235, (Sep. 2000).
Orme, et al., "Charged Molten Metal Droplet Deposition As a Direct Write Technology", MRS 2000 Spring Meeting, San Francisco, (Apr. 2000).
Pant, et al., "Behavior of expanding laser produced plasma in a magnetic field," *Physica Sripta*, T75:104-111, (1998).
Partlo, et al., "EUV (13.5nm) Light Generation Using a Dense Plasma Focus Device," *SPIE Proc. On Emerging Lithographic Technologies III*, vol. 3676, 846-858 (Mar. 1999).
Pearlman et al., "X-ray lithography using a pulsed plasma source," *J. Vac. Sci. Technol*., pp. 1190-1193 (Nov./Dec. 1981).
Porter, et al., "Demonstration of Population Inversion by Resonant Photopumping in a Neon Gas Cell Irradiated by a Sodium Z Pinch," *Phys. Rev. Let.*, 68(6):796-799, (Feb. 1992).
Price, Robert H., "X-Ray Microscopy using Grazing Incidence Reflection Optics," *Am. Inst. Phys.* , pp. 189-199, (1981).
Qi, et al., "Fluorescence in Mg IX emission at 48.340 Å from Mg pinch plasmas photopumped by Al XI line radiation at 48.338 Å," *The Am. Phys. Soc.*, 47(3):2253-2263 (Mar. 1993).
Sae-Lao et al., "Performance of normal-incidence molybdenum-yttrium multilayer-coated diffraction grating at a wavelength of 9 nm," *Applied Optics*, 41(13): 2394-1400 (May 1, 2002).
Sae-Lao et al., "Molybdenum-strontium multiplayer mirrors for the 8-12-nm extreme-ultraviolet wavelength region," *Optics Letters*, 26(7):468-470, (Apr. 1, 2001).
Sae-Lao et al., "Measurements of the refractive index of ytrrium in the 50-1300-eV energy region," *Applied Optics*, 41(34):7309-7316 (Dec. 1, 2002).
Scheuer, et al., "A Magnetically-Nozzled, Quasi-Steady, Multimegawatt, Coaxial Plasma Thruster," *IEEE: Transactions on Plasma Science*, 22(6) (Dec. 1994).
S. Schiemann et al., "Efficient temporal compression of coherent nanosecond pulses in a compact SBS generator-amplifier setup", *IEEE J. QE* 33, 358-366 (1997).
Schriever, et al., "Laser-produced lithium plasma as a narrow-band extended ultraviolet radiation source for photoelectron spectroscopy," *App. Optics*, 37(7):1243-1248, (Mar. 1998).
Schriever, et al., "Narrowband laser produced extreme ultraviolet sources adapted to silicon/molybdenum multilayer optics," *J. of App. Phys*., 83(9):4566-4571, (May 1998).
Sharafat et al., Coolant Structural Materials Compatibility, Joint APEX Electronic Meeting, UCLA, (Mar. 24, 2000).
Shiloh et al., "Z Pinch of a Gas Jet," *Physical Review Lett*., 40(8), pp. 515-518 (Feb. 20, 1978).
Silfvast, et al., "High-power plasma discharge source at 13.5 nm and 11.4 nm for EUV lithography," *SPIE*, vol. 3676:272-275, (Mar. 1999).
Silfvast, et al., "Lithium hydride capillary discharge creates x-ray plasma at 13.5 nanometers," *Laser Focus World*, p. 13. (Mar. 1997).
Singh et al., "Design of multiplayer extreme-ultraviolet mirrors for enhanced reflectivity," *Applied Optics*, 39(13):2189-2197 (May 1, 2000).
Soufli, et al., "Absolute photoabsorption measurements of molybdenum in the range 60-930 eV for optical constant determination," *Applied Optics* 37(10): 1713-1719 (Apr. 1, 1998).
Srivastava et al., "High-temperature studies on Mo-Si multilayers using transmission electron microscope," *Current Science*, 83 (8):997-1000 (Oct. 25, 2002).
Stallings et al., "Imploding argon plasma experiments," *Appl. Phys. Lett*., 35(7), pp. 524-526 (Oct. 1, 1979).
Tada et al., "1-pm spectrally narrowed compact ArF excimer laser for microlithography", Laser and Electro-Optics, CLEO '96, CThG4, p. 374 (1996).
Takahashi, E., et al., "KrF laser picosecond pulse source by stimulated scattering processes", *Opt. Commun*. 215, 163-167 (2003).
Takahashi, E., et al., "High-intensity short KrF laser-pulse generation by saturated amplification of truncated leading-edge pulse", *Opt. Commun*. 185, 431-437 (2000).
Takenaka, et al., "Heat resistance of Mo/Si, $MoSi_2$/Si, and $Mo_5Si_3$/Si multiplayer soft x-ray mirrors," *J. Appl. Phys*. 78(9) 5227-5230 (Nov. 1, 1995).
Tillack, et al., "Magnetic Confinement of an Expanding Laser-Produced Plasma", UC San Diego, Center for Energy Research, UCSD Report & Abramova—Tornado Trap.
Wilhein, et al., "A slit grating spectrograph for quantitative soft x-ray spectroscopy," *Am. Inst. Of Phys. Rev. of Sci. Instrum*., 70(3):1694-1699, (Mar. 1999).
Wu, et al., "The vacuum Spark and Spherical Pinch X-ray/EUV Point Sources," *SPIE, Conf. On Emerging Tech. III*, Santa Clara, CA, vol. 3676:410-420, (Mar. 1999).
Yusheng et al., "Recent progress of "Heaven-One" high power KrF excimer laser system", Laser and Electro-Optics, CLEO '96, CThG4, p. 374 (1996).
Zombeck, M.V., "Astrophysical Observations with High Resolution X-ray Telescope," *Am. Inst. Of Phys.*, pp. 200-209, (1981).

* cited by examiner

EUV LIGHT SOURCE

CROSS-REFERENCE TO RELATED APPLICATIONS

The present application is related to co-pending and co-owned U.S. patent applications Ser. Nos. 11/174,443, entitled LPP EUV PLASMA SOURCE MATERIAL TARGET DELIVERY SYSTEM, filed on Jun. 29, 2005, and 11/168,190, entitled EUV LIGHT SOURCE COLLECTOR LIFETIME IMPROVEMENTS, filed on Jun. 27, 2005, and 11/067,124, entitled METHOD AND APPARATUS FOR EUV PLASMA SOURCE TARGET DELIVERY, filed on Feb. 25, 2005; and 10/900,839, entitled EUV LIGHT SOURCE, filed on Jul. 27, 2004, the disclosures of which are hereby incorporated by reference. The present application claims priority to U.S. Provisional Application Ser. No. 60/733,658, entitled EUV LIGHT SOURCE, filed on Nov. 5, 2005 and co-owned by applicants' assignee, the disclosure of which is hereby incorporated by reference.

FIELD OF THE INVENTION

The present invention related to laser produced plasma extreme ultraviolet light sources.

BACKGROUND OF THE INVENTION

Laser produced plasma ("LPP") extreme ultraviolet light ("EUV"), e.g., at wavelengths below about 50 nm, using plasma source material targets in the form of a jet or droplet forming jet or droplets on demand comprising plasma formation material, e.g., lithium, tin, xenon, in pure form or alloy form (e.g., an alloy that is a liquid at desired temperatures) or mixed or dispersed with another material, e.g., a liquid. Delivering this target material to a desired plasma initiation site, e.g., at a focus of a collection optical element presents certain timing and control problems that applicants propose to address according to aspects of embodiments of the present invention.

U.S. Pat. No. 6,541,786, entitled PLASMA PINCH HIGH ENERGY WITH DEBRIS COLLECTOR, issued on Apr. 1, 2003, to Partlo, et al, and co-owned by applicants' assignee, and patents issued on parent applications of the application from which the U.S. Pat. No. 6,541,786 patent issued, and U.S. Pat. No. 4,589,123, entitled SYSTEM FOR GENERATING SOFT X RAYS, issued to Pearlman et al. on May 13, 1986, and Japanese laid open applications 08-321395, published on Dec. 3, 1996, with Kamitaka et al. inventors and assigned to Nikon Corp, and 09-245992, published on Sep. 19, 1997, with inventors Kamitaka et al. and assigned to Nikon Corp., relate to debris management in the vicinity of the exit opening for plasma generated EUV light sources.

SUMMARY OF THE INVENTION

An EUV light source and method of operating same is disclosed which may comprise: an EUV plasma production chamber comprising a chamber wall comprising an exit opening for the passage of produced EUV light focused to a focus point; a first EUV exit sleeve comprising a terminal end comprising an opening facing the exit opening; a first exit sleeve chamber housing the first exit sleeve and having an EUV light exit opening; a gas supply mechanism supplying gas under a pressure higher than the pressure within the plasma production chamber to the first exit sleeve chamber.

The first exit sleeve may be tapered toward the terminal end opening, and may, e.g., be conical in shape comprising a narrowed end at the terminal end. The apparatus and method may further comprise an EUV light receiving chamber housing the first exit sleeve chamber; a suction mechanism having a suction mechanism opening in the vicinity of the EUV exit opening of the first exit sleeve chamber removing EUV production material entering the EUV light receiving chamber through the EUV exit opening in the first exit sleeve chamber. The apparatus and method may further comprise the EUV producing plasma production chamber comprising a second EUV exit sleeve comprising an exit opening facing an inlet opening of the first exit sleeve; a second exit sleeve chamber housing the second exit sleeve and having an EUV light exit opening; a suction mechanism removing EUV production debris from the second exit sleeve housing. The method and apparatus may comprise a plasma production chamber comprising an EUV utilization device connection mechanism attached to the plasma production chamber; the attachment of the utilization device connection mechanism to the plasma production chamber being through a flexible coupling. The flexible coupling may allow for positioning of a beam of EUV light produced in the plasma production chamber relative to the attachment utilization device connection mechanism, and may, e.g., be a bellows. The method and apparatus may comprise an EUV plasma production chamber; an EUV light collector within the chamber comprising a first focus and a second focus, plasma forming the EUV light being collected by the EUV light collector being formed in the vicinity of the first focus and as beam of exiting EUV light exiting the EUV light source chamber being focused to the second focus in the vicinity of an exit opening; a second focus alignment sensing mechanism comprising: an image detection mechanism imaging the second focus through the first focus and the collector; an alignment indicator indicating the position of the exiting beam in relation to the exit opening. The image detection mechanism may comprise a camera. The exit opening may comprise an exit aperture leading to an EUV light utilization apparatus and fixed in space in relation to the EUV utilization apparatus. The method and apparatus may further comprise the alignment indicator may comprise a target positioned at the exit aperture or a contrast detector detecting contrast between the image of the primary focus and the image of the intermediate focus. The second EUV exit sleeve exit opening may comprise a differential vacuum aperture.

DETAILED DESCRIPTION OF PREFERRED EMBODIMENTS

Figure 1:
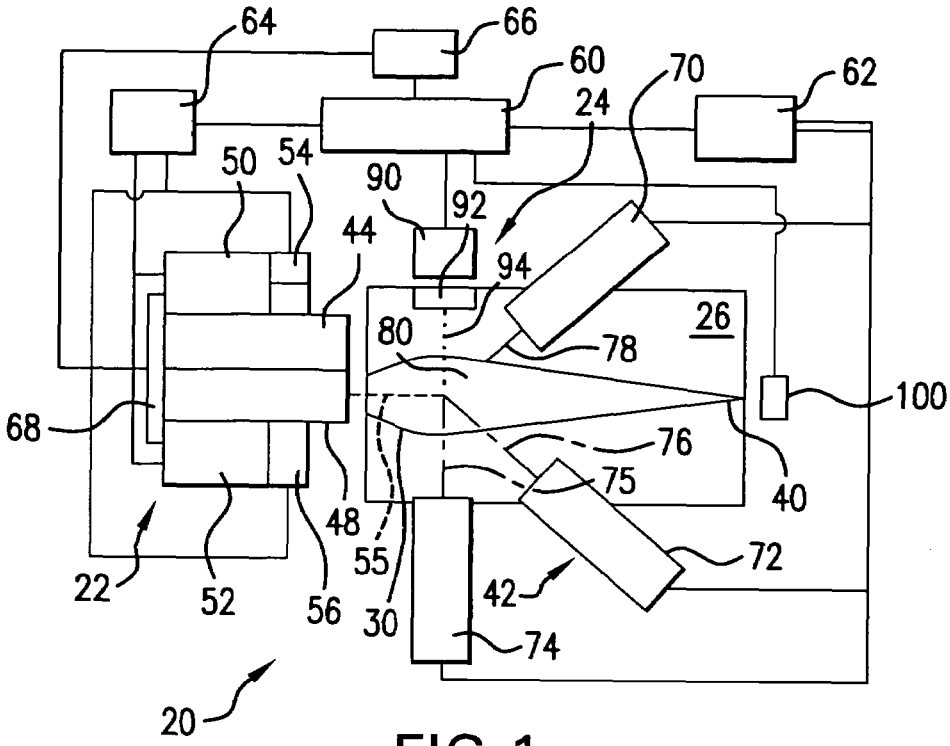
FIG. 1 shows schematically and in block diagram form an exemplary extreme ultraviolet ("EUV") light source (otherwise known as a soft X-ray light source) according to aspects of an embodiment of the disclosed subject matter.

Turning now to FIG. 1 there is shown a schematic view of an overall broad conception for an EUV light source, e.g., a laser produced plasma EUV light source 20 according to an aspect of the present invention. The light source 20 may contain a pulsed laser system 22, e.g., a gas discharge excimer or molecular fluorine laser operating at high power and high pulse repetition rate and may be a MOPA configured laser system, e.g., as shown in U.S. Pat. Nos. 6,625,191, 6,549,551, and 6,567,450. The light source 20 may also include a target delivery system 24, e.g., delivering targets in the form of liquid droplets, solid particles or solid particles contained within liquid droplets. The targets may be delivered by the target delivery system 24, e.g., into the interior of a chamber 26 to an irradiation site 28, otherwise known as an ignition site or the sight of the fire ball, which is where irradiation by the laser causes the plasma to form from the target material. Embodiments of the target delivery system 24 are described in more detail below.

Laser pulses delivered from the pulsed laser system 22 along a laser optical axis 55 through a window (not shown) in the chamber 26 to the irradiation site, suitably focused, as discussed in more detail below in coordination with the arrival of a target produced by the target delivery system 24 to create an x-ray releasing plasma, having certain characteristics, including wavelength of the x-ray light produced, type and amount of debris released from the plasma during or after ignition, according to the material of the target.

The light source may also include a collector 30, e.g., a reflector, e.g., in the form of a truncated ellipse, with an aperture for the laser light to enter to the irradiation site 28. Embodiments of the collector system are described in more detail below. The collector 30 may be, e.g., an elliptical mirror that has a first focus at the plasma initiation site 28 and a second focus at the so-called intermediate point 40 (also called the intermediate focus 40) where the EUV light is output from the light source and input to, e.g., an integrated circuit lithography tool (not shown). The system 20 may also include a target position detection system 42. The pulsed system 22 may include, e.g., a master oscillator-power amplifier ("MOPA") configured dual chambered gas discharge laser system having, e.g., an oscillator laser system 44 and an amplifier laser system 48, with, e.g., a magnetic reactor-switched pulse compression and timing circuit 50 for the oscillator laser system 44 and a magnetic reactor-switched pulse compression and timing circuit 52 for the amplifier laser system 48, along with a pulse power timing monitoring system 54 for the oscillator laser system 44 and a pulse power timing monitoring system 56 for the amplifier laser system 48. The system 20 may also include an EUV light source controller system 60, which may also include, e.g., a target position detection feedback system 62 and a firing control system 64, along with, e.g., a laser beam positioning system 66.

The target position detection system 42 may include a plurality of droplet imagers 70, 72 and 74 that provide input relative to the position of a target droplet, e.g., relative to the plasma initiation site and provide these inputs to the target position detection feedback system, which can, e.g., compute a target position and trajectory, from which a target error can be computed, if not on a droplet by droplet basis then on average, which is then provided as an input to the system controller 60, which can, e.g., provide a laser position and direction correction signal, e.g., to the laser beam positioning system 66 that the laser beam positioning system can use, e.g., to control the position and direction of the laser position and direction changer 68, e.g., to change the focus point of the laser beam to a different ignition point 28.

The imager 72 may, e.g., be aimed along an imaging line 75, e.g., aligned with a desired trajectory path of a target droplet 94 from the target delivery mechanism 92 to the desired plasma initiation site 28 and the imagers 74 and 76 may, e.g., be aimed along intersecting imaging lines 76 and 78 that intersect, e.g., alone the desired trajectory path at some point 80 along the path before the desired ignition site 28.

The target delivery control system 90, in response to a signal from the system controller 60 may, e.g., modify the release point of the target droplets 94 as released by the target delivery mechanism 92 to correct for errors in the target droplets arriving at the desired plasma initiation site 28.

An EUV light source detector 100 at or near the intermediate focus 40 may also provide feedback to the system controller 60 that can be, e.g., indicative of the errors in such things as the timing and focus of the laser pulses to properly intercept the target droplets in the right place and time for effective and efficient LPP EUV light production.

Figure 2:
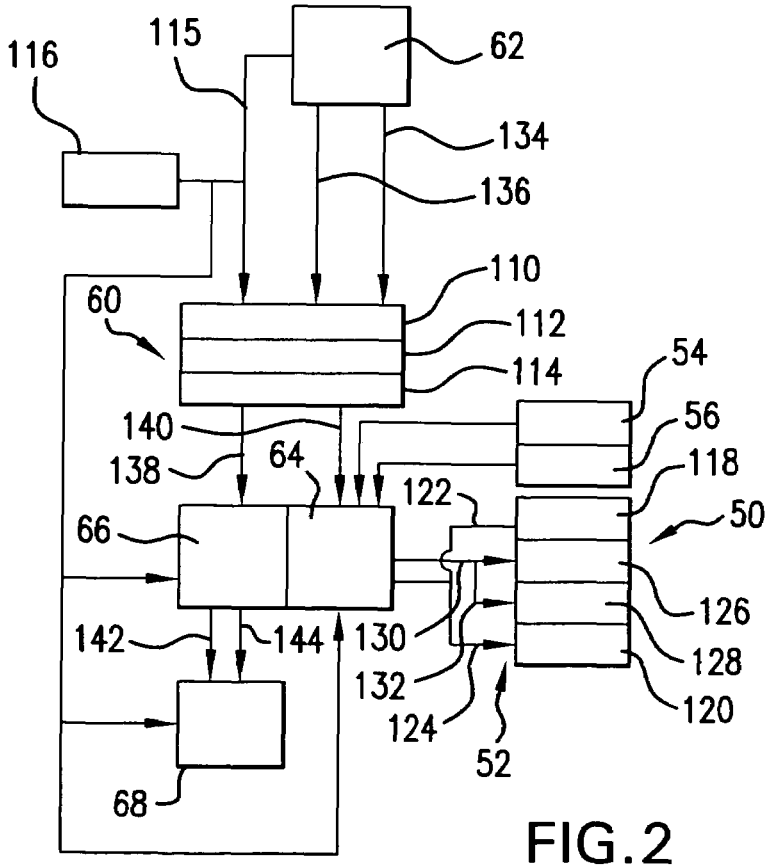
FIG. 2 shows schematically and in block diagram form an exemplary extreme ultraviolet ("EUV") controller system according to aspects of an embodiment of the disclosed subject matter.

Turning now to FIG. 2 there is shown schematically further details of a controller system 60 and the associated monitoring and control systems, 62, 64 and 66 as shown in FIG. 1. The controller may receive, e.g., a plurality of position signal 134, 136 a trajectory signal 136 from the target position detection feedback system, e.g., correlated to a system clock signal provided by a system clock 116 to the system components over a clock bus 115. The controller 60 may have a pre-arrival tracking and timing system 110 which can, e.g., compute the actual position of the target at some point in system time and a target trajectory computation system 112, which can, e.g., compute the actual trajectory of a target drop at some system time, and an irradiation site temporal and spatial error computation system 114, that can, e.g., compute a temporal and a spatial error signal compared to some desired point in space and time for ignition to occur.

The controller 60 may then, e.g., provide the temporal error signal 140 to the firing control system 64 and the spatial error signal 138 to the laser beam positioning system 66. The firing control system may compute and provide to a resonance charger portion 118 of the oscillator laser 44 magnetic reactor-switched pulse compression and timing circuit 50 a resonant charger initiation signal 122 and may provide, e.g., to a resonance charger portion 120 of the PA magnetic reactor-switched pulse compression and timing circuit 52 a resonant charger initiation signal, which may both be the same signal, and may provide to a compression circuit portion 126 of the oscillator laser 44 magnetic reactor-switched pulse compression and timing circuit 50 a trigger signal 130 and to a compression circuit portion 128 of the amplifier laser system 48 magnetic reactor-switched pulse compression and timing circuit 52 a trigger signal 132, which may not be the same signal and may be computed in part from the temporal error signal 140 and from inputs from the light out detection apparatus 54 and 56, respectively for the oscillator laser system and the amplifier laser system.

The spatial error signal may be provided to the laser beam position and direction control system 66, which may provide, e.g., a firing point signal and a line of sight signal to the laser beam positioner which may, e.g. position the laser to change the focus point for the ignition site 28 by changing either or both of the position of the output of the laser system amplifier laser 48 at time of fire and the aiming direction of the laser output beam.

Applicants propose a method and apparatus to suppress the flow of HBr etch gas and other gasses in the EUV source plasma generation chamber 26 and other materials carried in such gas(es) from passing into the region behind the intermediate focus 40, This is necessary, e.g., in order to the exposure tool from influx of gases and contaminants from the EUV source chamber 26.

According to aspects of an embodiment of the present invention, e.g., a noble gas, e.g., argon gas may be in the region of the intermediate focus 40, e.g., at an intermediate focus aperture 150. The noble gas may be introduced, e.g., in front of the intermediate focus (IF) 40 in a short region between two (or more) apertures, the intermediate focus aperture 150 and a cone aperture 152 at the terminus of an intermediate focus cone 160.

The intermediate focus cone 160 may be a part of an intermediate focus region of the EUV chamber 26 and be an extension through an intermediate focus cone bulkhead 170 which may, e.g., be formed integrally with an intermediate focus bulkhead flange 172. The intermediate focus aperture 150 may, e.g., be formed in an intermediate focus aperture plate 174 attached by suitable means, e.g., by welding to an intermediate focus cone housing 176, which may in turn be attached, by suitable means, e.g., welding, to the intermediate focus cone bulkhead 170. The intermediate focus bulkhead flange 170 may be attached by suitable means, e.g., by welding to a generally cylindrical turbo pump housing 180 which may form a portion of a turbo pump 182, e.g., having an inlet 184 and an outlet 186. The opposing end of the cylindrical housing 180 may be attached by suitable means, e.g., by welding to a turbo pump attachment flange 190.

Within the interior of the turbo pump housing 180 may be a differential vacuum aperture 200, formed in a differential vacuum aperture plate 202, which may from the terminus of a generally cylindrical differential vacuum aperture housing 204. The differential vacuum aperture plate housing 204 may be attached by a suitable means, e.g., by welding to a differential vacuum aperture plate housing attachment flange 210, The flange 210 may be attached by suitable means, e.g., by welding or bolting to the turbo pump attachment flange 190 at the opposite end of a differential vacuum aperture opening 212 from the cylindrical housing 180.

It will be understood by those in the art that this arrangement of the vacuum pump 182 and the differential vacuum aperture 200 and housing 204 may be utilized to maintain a slightly higher vacuum pressure at the intermediate focus side of the aperture 200 than in the EUV source chamber 26, to thereby also discourage gas and entrapped debris from flowing toward the intermediate focus cone 160.

A noble gas, e.g., argon can be inserted under pressure through an argon gas inlet 230 into an intermediate focus gas plenum 232 and removed through an argon gas outlet 234. It will be understood that the noble gas, e.g., argon gas can thus be passed into the plenum 232 around the exterior of the intermediate focus cone 160, between the aperture at the terminus of the intermediate focus cone 160 and both through the aperture at the terminus of the intermediate focus cone 160 and the intermediate focus aperture 150 in the intermediate focus aperture plate 174. This can be used, e.g., to further insure that the EUV source chamber 26 gas(s) and other debris does not reach the intermediate focus aperture and enter the lithography tool (not shown) that in operation can be affixed to the intermediate focus aperture plate 174 by suitable means, e.g., by bolting.

The aforementioned flow of gas can also, therefore, e.g., act as a buffer gas curtain. The gas and debris which does manage to reach the space between the intermediate focus gas cone aperture 152 and the intermediate focus aperture plate 174, e.g., can be pumped out from the gas plenum 232 area through gas outlet 234 before reaching, e.g., the intermediate focus 40. Gas molecules and very small debris particles that would normally flow from the EUV source chamber 40 through these apertures 152, 150 and to the intermediate focus and, e.g., into the lithography tool (e.g., into the illuminator) and/or to intermediate focus metrology detectors, can, e.g., undergo collisions with the argon buffer gas and be slowed and changed in direction and pumped away. The gas curtain can, e.g., prevent the transmission of mainly etch and background gases, as well as contaminants and small debris particles from the source chamber, that may be flowing with and/or entrapped within the gas(es), from reaching the region past the intermediate focus aperture 174. The delicate optics in the exposure tool may thus be protected from the influx of debris particles, etch gases and other contaminants present in the source chamber 26. A more than 1000-fold suppression of transmission of gases from the source chamber 26 to the region beyond the intermediate focus is expected.

Argon gas, e.g., may be chosen as a buffer gas since it is highly transparent to the 13.5 nm EUV radiation. A partial pressure of argon of up to a few mTorr can be tolerated in this region and in at least the light entrance environs of the lithography exposure tool. Helium and hydrogen gas are also highly transparent to 13.5 nm EUV radiation and may be considered, as well. However, argon atoms are believed now to be more efficient in deflecting other particles and gas molecules since argon atoms are heavier than helium atoms or hydrogen molecules. The gas curtain as illustratively shown in FIG. 3 is believed to be most advantageously located just before the intermediate focus, since the cone of EUV light is small in this region and thus, e.g., only a small buffer gas volume may be required.

Figure 3:
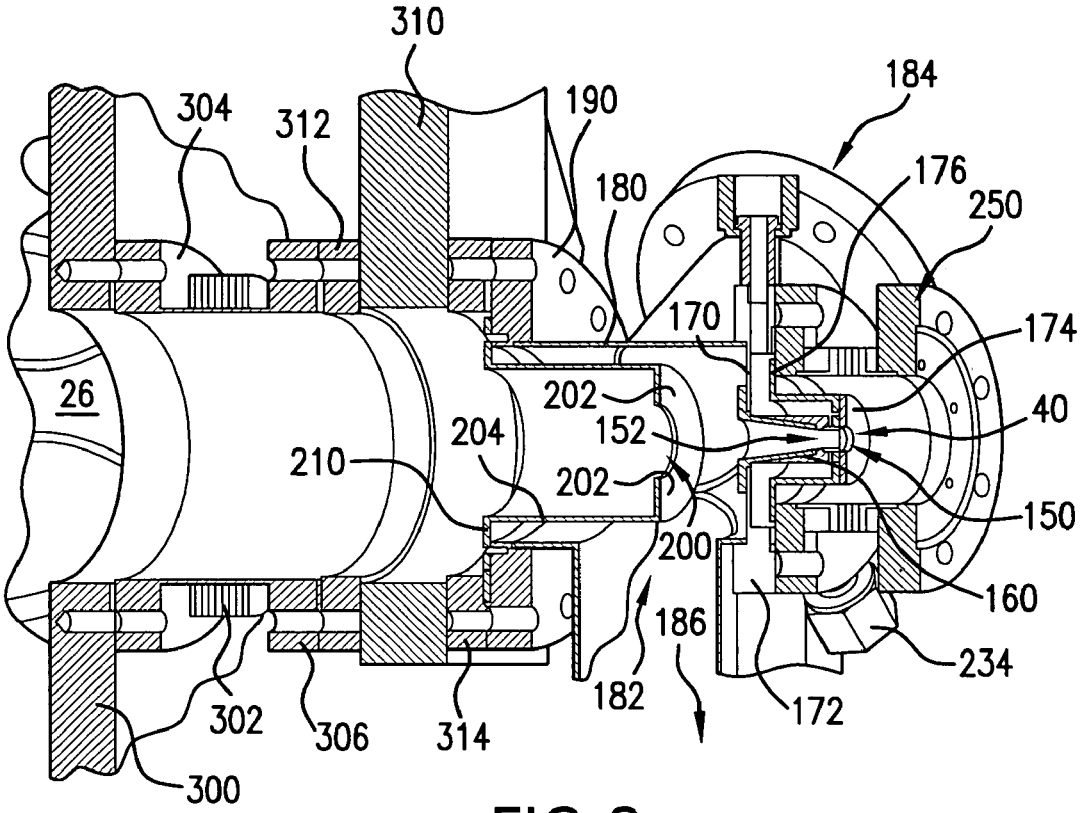
FIG. 3 shows a perspective partly cut away view of an illustrative EUV light source output interface according to aspects of an embodiment of the disclosed subject matter.
Figure 4:
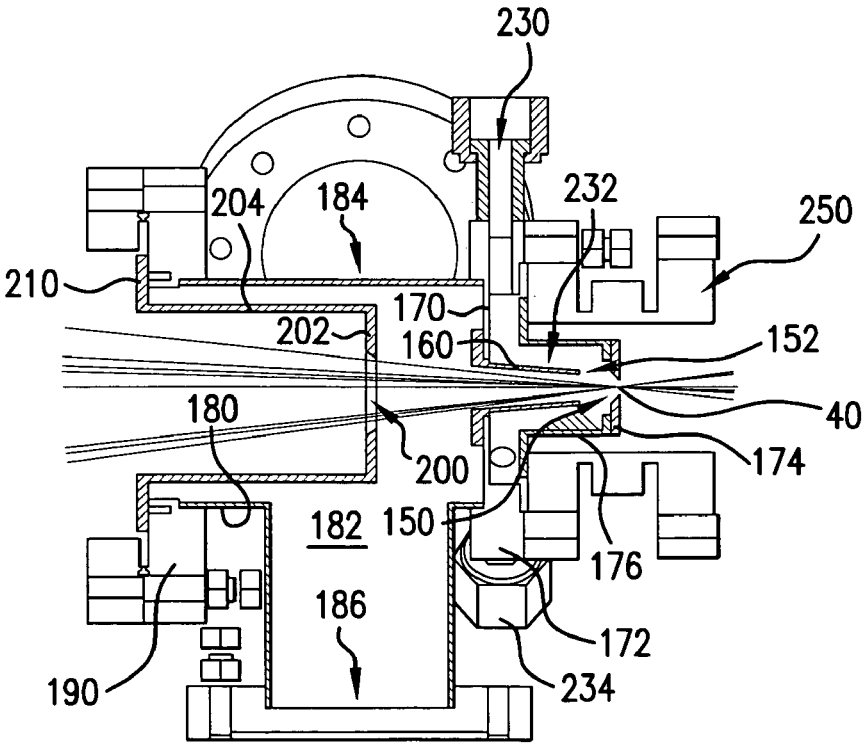
FIG. 4 shows a perspective partly cut away view of an illustrative EUV light source output interface according to aspects of an embodiment of the disclosed subject matter.

As has been shown illustratively in FIG. 3, e.g., several apertures, e.g., two, i.e., apertures 152, 150, may be installed in the intermediate focus region, e.g., just in front of the intermediate focus, which may, e.g., lie within the intermediate focus aperture 150, with, e.g., the intermediate focus cone 160 having, e.g., a diameter size only slightly larger than the usable EUV light cone, as shown, e.g., in the cross-sectional view of the apparatus of FIG. 3 in FIG. 4. Argon gas is introduced between apertures 150, 152 in a region of about 1 cm in length before the intermediate focus. The etch gas and the argon gas, etc., may first be almost completely effectively pumped away in another region defined by the apertures 152, 200, further in front of the intermediate focus, for example, in the housing of the turbo-molecular pump 182, which may be corrosion-resistant, due to the presence, e.g., of HBr etching gas.

The second aperture 152 may be at the terminus of the intermediate focus aperture cone 160, which may be cone-shaped to define a gas collision region. For example, the pressure in the region of the apertures 152 may form, e.g., a region of diffusive flow, e.g., with small mean-free path (mm-range) between collisions, e.g., to ensure that the etch gas and debris and contaminants cannot pass through the region of the gas curtain between apertures 152 and 150 without undergoing collisions leading to a large suppression of unwanted gas(es) and contaminants.

The intermediate focus aperture 150 may be selected to be smaller than the other apertures, e.g., aperture 152, the purging gas, e.g., argon gas may be caused to be mainly flowing towards the source chamber 26 and is further pumped away in the pumping region within the turbo-molecular pump. A small portion of the argon gas is flowing into the region behind the intermediate focus, i.e., into and through the intermediate focus aperture 150, however, this can be tolerated, since argon is highly transparent to 13.5 nm EUV radiation.

Also almost all of the gas in the region between apertures 152, 150 just in front of the intermediate focus is argon. Remaining contaminants from the source chamber 26 can the undergo collisions with the argon atoms flowing towards the source chamber and are pumped away in the aperture region further in front or in the source chamber, or are pumped out with purge gas flow through the outlet 234.

In a second embodiment, the argon can also be made to flow through other additional orifices (not shown) directed away from the intermediate focus aperture 150 towards the chamber 26 to establish a flow direction opposite to the gas flow direction of etch gas and debris from the source chamber.

Typical parameters may be, e.g., for HBr etch gas in source chamber, 20-30 mTorr, argon flow and pressure in gas curtain region, 10-20 sccm, 10-100 mTorr, argon background gas in region beyond the intermediate focus, 1-5 mTorr For certain applications of utilization of EUV light produced as noted above, e.g., for semiconductor lithography, an EUV "point" source must be aligned, e.g., in 5 degrees of freedom with respect to the optical relay lensing housed within the litho stepper (not shown) to which it interfaces, e.g., as by being bolted to the intermediate focus aperture plate 174. Thus the intermediate focus aperture plate 174 and its associated structure, e.g., as illustrated by way of example in FIGS. 3 and 4, will, in operation, remain fixed in space with respect to the lithography tool (not shown) and its optics with their generally fixed optical train and optical axis for the passage of the EUV light from the source 20 to the integrated circuit fabrication wafer to be exposed with the EUV light. It will be understood that the bellows connection 250 illustrated in FIGS. 3 and 4 is not in place in operation of the EUV source 20, but may be attached for the connection of metrology apparatus and provides for such apparatus generally five degrees of freedom in motion needed to perform the metrology function.

The EUV collector optic 30 may be, e.g., a reflectively coated elliptical substrate. Of the ellipse's two focal points, the one nearest the substrate is termed primary focus, since this is the point 28 where EUV energy is produced by plasma formation. The second focal point is termed the "Intermediate Focus" and represents the zone at which the EUV light source and an EUV lithography stepper interface.

From a system perspective, maintaining energy focus at intermediate focus 40 can be of paramount importance (as the lithography tool—stepper/scanner—has its own optical relay lensing). To assure proper positioning of the intermediate focal point 40 it may be necessary to have adjustability with regard to the nominal placement of the collector optic (and thus the primary focal point, e.g., where the plasma formation point 28 is desired to be kept). With regard to heat loading or other dynamic deformation of the collector optic 30 during operation, it is likely that an active positioning system for the collector 30 will also be required. The bellows arrangement 302 shown in FIGS. 3 and 4 allows for six degrees of freedom in moving the collector and the primary focus 28 vis a vis the fixed in space (when connected to a lithography tool) intermediate focus 40.

Such positioning requires active feedback from some sensing device(s) to determine positioning of the primary focus 28 with respect to the fixed intermediate focus position 40. According to aspect of an embodiment of the present invention, applicants propose to provide feedback with respect to alignment of primary and intermediate focal point 28, 40 in 3 axes, referred to as X, Y, and Z axes, with the Z axis being longitudinally along the beam (cone) of EUV light from the collector 30 to the intermediate focus 40 and the X and Y axis lying in a plane orthogonal to the X axis.

Figure 5:
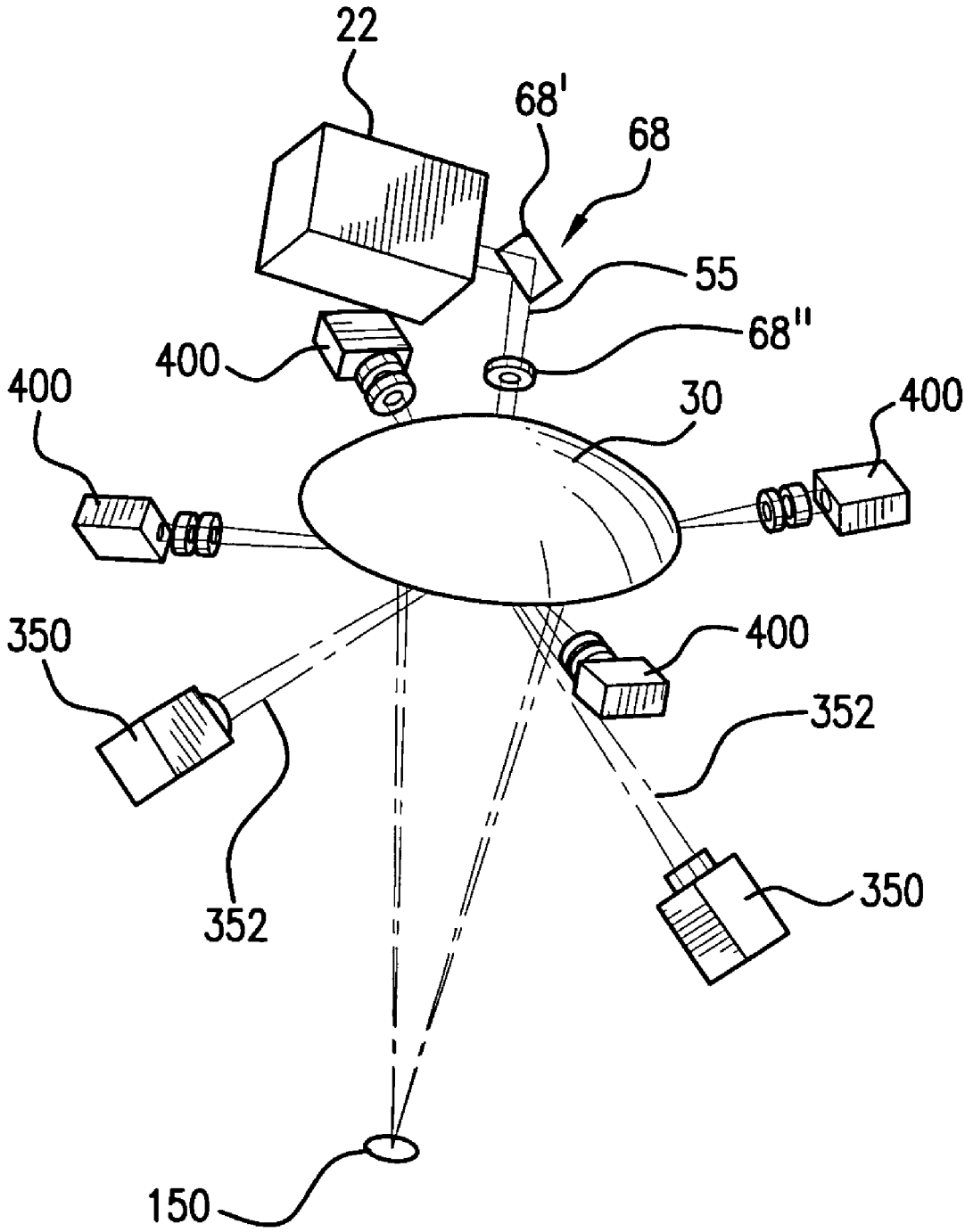
FIG. 5 shows a cross sectional partly cut-away view of an illustrative EUV light source output interface according to aspects of an embodiment of the disclosed subject matter.

Feedback may be in situ with regard to operation of the LPP device, i.e., from within the chamber 26, requiring no downtime to recalibrate the alignment. Turning to FIG. 5 there is shown by way of illustration a schematic view of an example of EUV metrology according to aspects of an embodiment of the present invention, where, e.g., a plurality of image detectors, e.g., a plurality of cameras 350, e.g., two cameras 350, illustrated in the present application for the sake of clarity. However, in order to collect feedback from three degrees of freedom (XYZ), or more, it is anticipated that at least three cameras 350 may be required.

The cameras 350 may be positioned so that, e.g., their field of view includes a portion of the optical surface of the elliptical collector optic 30 (that relays focused EUV energy to intermediate focus 40). The cameras 350 may be lensed, e.g., with lenses on the cameras 350 and/or lenses 352 such that, e.g., a sharp image of the primary focus 28 and (via a bounce off of the elliptical collector 30) also the intermediate focus 40, and/or the intermediate focus aperture 150 is captured. When alignment is "true" the plasma event at or in the close vicinity of the primary focus 28 will be essentially coaxial with the physical aperture 150 at intermediate focus 40. Thus giving an indication of the positioning of the plasma formed at or in the near vicinity of the primary focus 28 vis-a-vis the fixed location of the intermediate focus 40. This may be possible with or without a third camera 350, e.g., with a focus or contrast detector, or both, viewing the image of the plasma event and the position thereof relative to the center of the aperture 150. The EUV energy detectors 400 positioned, e.g., at four quadrants of the plasma emission distribution, e.g., in the plane of the X and Y axis may also be useful in this regard.

X and Y positioning of the primary focus 28, vis a vis the intermediate focus 40 may also be best viewed, e.g., via the two cameras illustrated in FIG. 5, e.g., oriented at 90 or 180 degrees with respect to one another. Other angular orientations are valid, but motion compensation loops become less intuitive. The viewing angle of these two cameras with respect to the central Z axis of the LPP device 20 should be identical. The viewing angle of a third camera 350 (not shown) could differ from the other two illustrated cameras 350, e.g., so as to detect errors along the Z axis. The greater the difference in viewing angle of this third camera 350 (not shown), the greater the resolution one could have with respect to determining the Z axis error.

An alternate methodology (using fewer cameras) could include a camera/lensing (not shown), e.g., with high NA/short depth of focus located on the far side of the intermediate focus 40 aperture 150. Z axis error also could be made evident, e.g., if the plasma event at or in the near vicinity of the primary focus 28 is unfocused, e.g., with respect to the intermediate focus aperture 150. This type of measurement with a far side camera, at least located along the Z axis can likely be done only with the intermediate focus aperture 150 not connected to, e.g., a lithography tool. The bellows arrangement 250 (shown in FIGS. 3 and 4 can be used for connection of such a metrology device and for allowing it some freedom of movement in several axes, e.g., in the Z axis to, e.g., focus the image of the plasma event to, e.g., determine the Z axis error, without having to move the chamber 26, e.g., prior to actually moving the chamber 26.

It will be understood by those skilled in the art that above an EUV light source and method of operating same is disclosed which, according to aspects of an embodiment of the present invention may comprise: an EUV plasma production chamber comprising a chamber wall comprising an exit opening for the passage of produced EUV light focused to a focus point, such as a wall of a unit meant to be attached to an EUV light utilization mechanism, e.g., a photolithography scanner or a wall that is integral with a chamber wherein plasma production of EUV light occurs and which may have other units or housings connected to it in series or nested or otherwise, e.g., as shown in FIGS. 3, 4 and 5. According to aspects of an embodiment of the present invention the apparatus and method may comprise a first EUV exit sleeve comprising a terminal end comprising an opening facing the exit opening; a first exit sleeve chamber which may house the first exit sleeve and may also have an EUV light exit opening. A gas supply mechanism may supply gas, such as a buffer gas, e.g., argon under a pressure higher than the pressure within the plasma production chamber to the first exit sleeve chamber, to thereby form, e.g., a gas curtain deterring the exit of material from the exit sleeve terminal aperture. The first exit sleeve may be tapered toward the terminal end opening, and may, e.g., be conical in shape comprising a narrowed end at the terminal end. The apparatus and method may further comprise an EUV light receiving chamber housing the first exit sleeve chamber and may include a suction mechanism, e.g., a pump, having a suction mechanism opening in the vicinity, e.g., near enough to most effectively remove the material that is not stopped by the buffer gas of the EUV exit opening of the first exit sleeve chamber. Such EUV production material prevented from entering the EUV light receiving chamber, which may in operation be attached to or a portion of an EUV light utilization apparatus, such as a photolithography scanner, may comprise gas constituents of the plasma production chamber contents, e.g., etching/cleaning gas(es), buffer gases (es), etc. or plasma formation debris, such as ions, plasma source material, or other materials, e.g., carried from or otherwise removed from surfaces in the chamber, e.g., bromine and/or hydrogen compounds. The apparatus and method may further comprise the EUV producing plasma production chamber comprising a second EUV exit sleeve comprising an exit opening facing an inlet opening of the first exit sleeve; a second exit sleeve chamber housing the second exit sleeve and having an EUV light exit opening; a suction mechanism, such as another pump, removing EUV production debris from the second exit sleeve housing. The method and apparatus may comprise a plasma production chamber comprising an EUV utilization device connection mechanism attached to the plasma production chamber, such as a mechanism including or connected to an intermediate focus aperture plate comprising an EUV intermediate focus aperture, positioned in the vicinity of the intermediate focus; the attachment of the utilization device connection mechanism to the plasma production chamber being through a flexible coupling. The flexible coupling may allow for positioning of a beam of EUV light produced in the plasma production chamber relative to the attachment utilization device connection mechanism, thus, to the desired position of the intermediate focus fixed in space as to the utilization device, and may, e.g., be a bellows. The bellows can allow, e.g., for several, e.g., six degrees of freedom of movement of the collector vis-a-vis the desired position of the intermediate focus, e.g., by moving the rest of the EUV plasma production chamber other than the portion(s) attached to the utilization mechanism. The method and apparatus may comprise an EUV plasma production chamber; an EUV light collector within the chamber comprising a first focus and a second focus, plasma forming the EUV light being collected by the EUV light collector being formed in the vicinity of the first focus and as beam of exiting EUV light exiting the EUV light source chamber being focused to the second focus in the vicinity of an exit opening, such as the intermediate focus aperture; a second focus alignment sensing mechanism comprising: an image detection mechanism imaging the second focus through the first focus and the collector; an alignment indicator indicating the position of the exiting beam in relation to the exit opening, such as the position of the actual second focus vis-a-vis the desired position of the second focus, e.g., in regard to the utilization tool, e.g., a indicated by the position of the EUV light exit aperture plate. The image detection mechanism may comprise a camera. The exit opening may comprise an exit aperture leading to an EUV light utilization apparatus and fixed in space in relation to the EUV utilization apparatus. The method and apparatus may further comprise the alignment indicator comprising a target positioned at the EUV intermediate focus aperture or a contrast detector detecting contrast between the image of the primary focus and the image of the intermediate focus. The second EUV exit sleeve exit opening may comprise a differential vacuum aperture, e.g., sized in relation to a pump drawing a suction on the downstream side of the second EUV light exit sleeve and to the pressure in the plasma production chamber to, e.g., maintain the downstream pressure higher than in the plasma production chamber, in order to, e.g., further discourage the passage of plasma production chamber material from the plasma production chamber toward the intermediate focus.

It will be understood by those skilled in the art that the aspects of embodiments of the present invention disclosed above are intended to be preferred embodiments only and not to limit the disclosure of the present invention(s) in any way and particularly not to a specific preferred embodiment alone. Many changes and modification can be made to the disclosed aspects of embodiments of the disclosed invention(s) that will be understood and appreciated by those skilled in the art. The appended claims are intended in scope and meaning to cover not only the disclosed aspects of embodiments of the present invention(s) but also such equivalents and other modifications and changes that would be apparent to those skilled in the art. In additions to changes and modifications to the disclosed and claimed aspects of embodiments of the present invention(s) noted above others could be implemented.

While the particular aspects of embodiment(s) of the EUV LIGHT SOURCE described and illustrated in this patent application in the detail required to satisfy 35 U.S.C. §112 is fully capable of attaining any above-described purposes for, problems to be solved by or any other reasons for or objects of the aspects of an embodiment(s) above described, it is to be understood by those skilled in the art that it is the presently described aspects of the described embodiment(s) of the present invention are merely exemplary, illustrative and representative of the subject matter which is broadly contemplated by the present invention. The scope of the presently described and claimed aspects of embodiments fully encompasses other embodiments which may now be or may become obvious to those skilled in the art based on the teachings of the Specification. The scope of the present EUV LIGHT SOURCE is solely and completely limited by only the appended claims and nothing beyond the recitations of the appended claims. Reference to an element in such claims in the singular is not intended to mean nor shall it mean in interpreting such claim element "one and only one" unless explicitly so stated, but rather "one or more". All structural and functional equivalents to any of the elements of the above-described aspects of an embodiment(s) that are known or later come to be known to those of ordinary skill in the art are expressly incorporated herein by reference and are intended to he encompassed by the present claims. Any term used in the specification and/or in the claims and expressly given a meaning in the Specification and/or claims in the present application shall have that meaning, regardless of any dictionary or other commonly used meaning for such a term. It is not intended or necessary for a device or method discussed in the Specification as any aspect of an embodiment to address each and every problem sought to be solved by the aspects of embodiments disclosed in this application, for it to be encompassed by the present claims. No element, component, or method step in the present disclosure is intended to be dedicated to the public regardless of whether the element, component, or method step is explicitly recited in the claims. No claim element in the appended claims is to be construed under the provisions of 35 U.S.C. §112, sixth paragraph, unless the element is expressly recited using the phrase "means for" or, in the case of a method claim, the element is recited as a "step" instead of an "act".

We claim:

1. An EUV light source comprising:

an EUV plasma production chamber comprising a chamber wall comprising an exit opening for the passage of produced EUV light focused to a focus point;

a first EUV exit sleeve comprising a terminal end comprising an opening facing the exit opening;

a first exit sleeve chamber housing the first exit sleeve and having an EUV light exit opening;

a gas supply mechanism supplying gas under a pressure higher than the pressure within the plasma production chamber to the first exit sleeve chamber.

2. The apparatus of claim 1 further comprising:

the first exit sleeve is tapered toward the terminal end opening.

3. The apparatus of claim 2 further comprising:

the first exit sleeve is conical in shape comprising a narrowed end at the terminal end.

4. The apparatus of claim 3 further comprising:

an EUV light receiving chamber housing the first exit sleeve chamber;

a suction mechanism having a suction mechanism opening in the vicinity of the EUV exit opening of the first exit sleeve chamber removing EUV production material entering the EUV light receiving chamber through the EUV exit opening in the first exit sleeve chamber.

5. The apparatus of claim 3 further comprising:

the EUV producing plasma production chamber comprising a second EUV exit sleeve comprising an exit opening facing an inlet opening of the first exit sleeve;

a second exit sleeve chamber housing the second exit sleeve and having an EUV light exit opening;

a suction mechanism removing EUV production debris from the second exit sleeve housing.

6. The apparatus of claim 5 further comprising:

the second EUV exit sleeve opening comprising a different vacuum aperture.

7. The apparatus of claim 2 further comprising:

the EUV producing plasma production chamber comprising a second EUV exit sleeve comprising an exit opening facing an inlet opening of the first exit sleeve;

a second exit sleeve chamber housing the second exit sleeve and having an EUV light exit opening;

a suction mechanism removing EUV production debris from the second exit sleeve housing.

8. The apparatus of claim 7 further comprising:

the second EUV exit sleeve exit opening comprising a differential vacuum aperture.

9. The apparatus of claim 1 further comprising:

the first exit sleeve is conical in shape comprising a narrowed end at the terminal end.

10. The apparatus of claim 9 further comprising:

an EUV light receiving chamber housing the first exit sleeve chamber;

a suction mechanism having a suction mechanism opening in the vicinity of the EUV exit opening of the first exit sleeve chamber removing EUV production material entering the EUV light receiving chamber through the EUV exit opening in the first exit sleeve chamber.

11. The apparatus of claim 9 further comprising:

the EUV producing plasma production chamber comprising a second EUV exit sleeve comprising an exit opening facing an inlet opening of the first exit sleeve;

a second exit sleeve chamber housing the second exit sleeve and having an EUV light exit opening;

a suction mechanism removing EUV production debris from the second exit sleeve housing.

12. The apparatus of claim 11 further comprising:

the second EUV exit sleeve exit opening comprising a differential vacuum aperture.

13. The apparatus of claim 1 further comprising:

the EUV producing plasma production chamber comprising a second EUV exit sleeve comprising an exit opening facing an inlet opening of the first exit sleeve;

a second exit sleeve chamber housing the second exit sleeve and having an EUV light exit opening;

a suction mechanism removing EUV production debris from the second exit sleeve housing.

14. The apparatus of claim 13 further comprising:

the second EUV exit sleeve exit opening comprising a differential vacuum aperture.

15. An EUV light source comprising:

an EUV plasma production chamber;

an EUV light collector within the chamber comprising a first focus and a second focus, plasma forming the EUV light being collected by the EUV light collector being formed in the vicinity of the first focus and as beam of exiting EUV light exiting the EUV light source chamber being focused to the second focus in the vicinity of an exit opening;

a second focus alignment sensing mechanism comprising:

an image detection mechanism imaging the second focus through the first focus and the collector;

an alignment indicator indicating the position of the exiting beam in relation to the exit opening.

16. The apparatus of claim 15 further comprising:

the image detection mechanism comprising a camera.

17. The apparatus of claim 16 further comprising:

the exit opening comprising an exit aperture leading to an EUV light utilization apparatus and fixed in space in relation to the EUV utilization apparatus.

18. The apparatus of claim 17 further comprising:

the alignment indicator comprising:

a target positioned at the exit aperture.

19. The apparatus of claim 17 further comprising:

the alignment indicator comprising:

a contrast detector detecting contrast between the image of the primary focus and the image of the intermediate focus.

20. The apparatus of claim 16 further comprising:

the alignment indicator comprising:

a target positioned at the exit aperture.

21. The apparatus of claim 16 further comprising:

the alignment indicator comprising:

a contrast detector detecting contrast between the image of the primary focus and the image of the intermediate focus.

22. The apparatus of claim 15 further comprising:

the exit opening comprising an exit aperture leading to an EUV light utilization apparatus and fixed in space in relation to the EUV utilization apparatus.

23. The apparatus of claim 22 further comprising:

the alignment indicator comprising:

a target positioned at the exit aperture.

24. The apparatus of claim 22 further comprising:

the alignment indicator comprising:

a contrast detector detecting contrast between the image of the primary focus and the image of the intermediate focus.

25. The apparatus of claim 15 further comprising:

the alignment indicator comprising:

a target positioned at the exit aperture.

26. The apparatus of claim 15 further comprising:

the alignment indicator comprising:

a contrast detector detecting contrast between the image of the primary focus and the image of the intermediate focus.

* * * * *